US008586887B2

(12) United States Patent
Chen

(10) Patent No.: US 8,586,887 B2
(45) Date of Patent: Nov. 19, 2013

(54) MEMBRANE CIRCUIT BOARD AND LUMINOUS KEYBOARD USING SAME

(75) Inventor: Chung-Yuan Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 160 days.

(21) Appl. No.: 13/239,755

(22) Filed: Sep. 22, 2011

(65) Prior Publication Data

US 2012/0318656 A1 Dec. 20, 2012

(30) Foreign Application Priority Data

Jun. 17, 2011 (TW) ..... 100121157 A

(51) Int. Cl.
*H01H 9/00* (2006.01)

(52) U.S. Cl.
USPC ..... 200/310

(58) Field of Classification Search
USPC ..... 200/5 R, 5 A, 46, 406, 511–514, 200/520–521, 308, 310–314, 317, 337, 341, 200/345
See application file for complete search history.

(56) References Cited

U.S. PATENT DOCUMENTS

| | | | | |
|---|---|---|---|---|
| 6,860,612 | B2 * | 3/2005 | Chiang et al. | 362/29 |
| 7,608,792 | B1 * | 10/2009 | Tsai | 200/310 |
| 7,888,613 | B2 * | 2/2011 | Jeffery et al. | 200/314 |
| 2008/0135392 | A1 * | 6/2008 | Huang et al. | 200/5 A |
| 2011/0089011 | A1 * | 4/2011 | Ozaki | 200/512 |

* cited by examiner

*Primary Examiner* — Edwin A. Leon
*Assistant Examiner* — Anthony R. Jimenez
(74) *Attorney, Agent, or Firm* — Kirton McConkie; Evan R. Witt

(57) ABSTRACT

A membrane circuit board and a luminous keyboard with such a membrane circuit board are provided. The membrane circuit board includes an upper wiring board and a lower wiring board. The upper wiring board has a first film layer and a first circuit pattern formed on a bottom surface of the first film layer. The lower wiring board has a second film layer, a second circuit pattern and a light reflective element arranged between the second film layer and the second circuit pattern. The first circuit pattern has a plurality of upper contact. The second circuit pattern has a plurality of lower contacts corresponding to respective upper contacts. The upper contacts and the corresponding lower contacts are collectively defined as a plurality of membrane switches. Moreover, a refractive index of the light reflective element is lower than a refractive index of the second film layer.

22 Claims, 9 Drawing Sheets

MEMBRANE CIRCUIT BOARD AND LUMINOUS KEYBOARD USING SAME

FIELD OF THE INVENTION

The present invention relates to a membrane circuit board, and more particularly to a membrane circuit board for use in a luminous keyboard.

BACKGROUND OF THE INVENTION

Recently, with increasing development of information industries, portable information devices such as notebook computers or personal digital assistants are widely used in many instances. In a case that a portable information device is used in a dim environment, the numbers and characters marked on the keys of the keyboard of the portable information device are not clearly visible. In other words, the dim environment becomes hindrance from operating the keyboard. In addition, if the keyboard is used in the dim environment, the user is readily suffered from vision impairment. For solving these drawbacks, a luminous keyboard has been disclosed. The luminous keyboard could be used in the dim environment in order to enhance the applications thereof. Moreover, by changing the arrangement of luminous regions, the information device having the luminous keyboard is more aesthetically-pleasing and thus the competiveness thereof is enhanced.

FIG. 1 is a schematic cross-sectional view illustrating a luminous keyboard according to the prior art. As shown in FIG. 1, the luminous keyboard 1 comprises a reflector 11, a light guide plate 12, a metallic base pate 13, a membrane circuit board 14, a plurality of keys 15 and light-emitting elements 16. The membrane circuit board 14 comprises a lower wiring board 141, an upper wiring board 142 and an intermediate board 143. The intermediate board 143 is arranged between the lower wiring board 141 and the upper wiring board 142. The lower wiring board 141, the intermediate board 143 and the upper wiring board 142 are made of transparent light-guiding material. The transparent light-guiding material includes for example polycarbonate (PC) or polyethylene (PE).

Please refer to FIG. 2, which is a schematic exploded view illustrating a membrane circuit board of the luminous keyboard of FIG. 1. The upper wiring board 142 has a first circuit pattern 1421. The first circuit pattern 1421 comprises a plurality of silver paste conductor lines 14211 and a plurality of upper contacts 14212. The lower wiring board 141 has a second circuit pattern 1411. The second circuit pattern 1411 comprises a plurality of silver paste conductor lines 14111 and a plurality of lower contacts 14112. The intermediate board 143 has a plurality of perforations 1431 corresponding to the upper contacts 14212 and the lower contacts 14112. Each of the upper contacts 14212 and the corresponding lower contact 14112 are collectively defined as a membrane switch 144. In addition, each key 15 has a keycap 151 and an elastic element 152. The elastic element 152 is arranged between the keycap 151 and the membrane circuit board 14.

When any key 15 is pressed down by a user, the elastic element 152 is compressed by the keycap 151, so that the corresponding upper contact 14212 is pushed by the elastic element 152. Consequently, the upper contact 14212 is contacted with the corresponding lower contact 14112 through a corresponding perforation 1431. In such way, the corresponding membrane switch 144 is electrically conducted, and the luminous keyboard 1 generates a corresponding key signal. Whereas, when the depressing force exerted on the keycap 151 is eliminated, an elastic force provided by the elastic element 152 is acted on the keycap 151. Due to the elastic force, the keycap 151 is moved upwardly and returned to its original position.

The light-emitting elements 16 are arranged at bilateral sides of the light guide plate 12 for emitting light beams. The light beams are incident to the light guide plate 12. The light guide plate 12 is disposed on the reflector 11. The metallic base plate 13 has a plurality of opening 131. The openings 131 are aligned with respective keys 15. After the light beams are incident to the light guide plate 12, the light beams are diffused into the whole light guide plate 12. Then, portions of the light beams are upwardly directed from the light guide plate 12 to the membrane circuit board 14 and the keys 15 through the perforations 131. In addition, other portions of the light beams are directed downwardly from the light guide plate 12 to the reflector 11 and reflected by the reflector 11, so that the reflected light beams are also directed upwardly. In such way, the light beams provided by the light-emitting elements 16 can be well utilized to illuminate the keys 15. However, the membrane circuit board 14 of the conventional luminous keyboard still has some drawbacks.

FIG. 3 schematically illustrates a light path in the lower wiring board of the membrane circuit board of FIG. 2. As shown in FIG. 3, the second circuit pattern 1411 is disposed on the top surface of the lower wiring board 141, and the second circuit pattern 1411 comprises a plurality of silver paste conductor lines 14111. Since these silver paste conductor lines 14111 have functions of collecting and scattering the light beams, after the light beams L1 provided by the light-emitting elements 16 are introduced into the lower wiring board 141 through the openings 141 of the metallic base plate 13, the light beams L2 passing through the silver paste conductor lines 14111 of the second circuit pattern 1411 seem very bright. Since most of the silver paste conductor lines 14111 are not aligned with the keys, the amount of light beams to be directed to the keys 15 to illuminate the keys 15 are consumed by the silver paste conductor lines 14111. That is, although the light beams L1 are mostly directed to the keys 15 according to the original design, the silver paste conductor lines 14111 may consume the amount of the light beams L2 because of the characteristics thereof. Consequently, only the light beams L3 are retained to be utilized by the luminous keyboard 1. Under this circumstance, the keys 15 of the luminous keyboard 1 fail to be effectively illuminated.

Therefore, the light use efficiency of the membrane circuit board 14 of the luminous keyboard 1 is insufficient and needs to be further improved.

SUMMARY OF THE INVENTION

The present invention provides a membrane circuit board with enhanced light use efficiency.

The present invention also provides a luminous keyboard using such a membrane circuit board.

In accordance with an aspect of the present invention, there is provided a luminous keyboard. The luminous keyboard includes at least one light-emitting element, a membrane circuit board and a plurality of keys. The membrane circuit board includes an upper wiring board and a lower wiring board. The light-emitting element is used for providing light beams to illuminate the luminous keyboard.

The upper wiring board includes a first film layer and a first circuit pattern formed on a bottom surface of the first film layer. The first circuit pattern has a plurality of upper contacts. The lower wiring board includes a second film layer, a second circuit pattern and a light reflective element arranged between the second film layer and the second circuit pattern. The second circuit pattern has a plurality of lower contacts corresponding to respective upper contacts. Each of the upper contacts and the corresponding lower contact are separated from each other by a spacing interval. In addition, each of the upper contacts and the corresponding lower contact are collectively defined as a membrane switch. A refractive index of the light reflective element is lower than a refractive index of the second film layer. When the keys are triggered, respective membrane switches are conducted.

In an embodiment, the second circuit pattern includes a plurality of metallic conductor lines.

In an embodiment, the metallic conductor lines are silver paste conductor lines.

In an embodiment, the light reflective element is a single film layer, and the metallic conductor lines are formed on the single film layer.

In an embodiment, the light reflective element is formed on the second film layer by a printing process, a film deposition process, a gluing process or a thermal compression process.

In an embodiment, the light reflective element includes a plurality of separate block-type film layers, and the metallic conductor lines are formed on the block-type film layers.

In an embodiment, the block-type film layers are formed on the second film layer by a printing process, a film deposition process, a gluing process or a thermal compression process.

In an embodiment, the second film layer is a light-guiding film layer.

In an embodiment, the light-guiding film layer is made of polycarbonate (PC), polyethylene terephthalate (PET) or polymethylmethacrylate (PMMA).

In an embodiment, the light-emitting element is a light emitting diode, which is located beside the membrane circuit board for emitting the light beams toward the membrane circuit board.

In an embodiment, the luminous keyboard further includes a base plate, wherein the base plate is disposed under the membrane circuit board for supporting the keys, the membrane circuit board and the light-emitting element.

In an embodiment, each of the keys has a keycap and an elastic element, and the elastic element is arranged between the keycap and the membrane circuit board. When the keycap is pressed down, the elastic element is compressed by the keycap to push against a corresponding membrane switch. Whereas, when a depressing force exerted on the keycap is eliminated, an elastic force provided by the elastic element is acted on the keycap, so that the keycap is returned to an original position.

In an embodiment, the membrane circuit board further includes an intermediate board, which is arranged between the upper wiring board and the lower wiring board, so that each of the upper contacts and the corresponding lower contact are separated from each other by the spacing interval. In addition, the intermediate board has a plurality of perforations corresponding to the lower contacts and the upper contacts.

In accordance with another aspect of the present invention, there is provided a membrane circuit board. The membrane circuit board includes an upper wiring board and a lower wiring board.

The upper wiring board includes a first film layer and a first circuit pattern formed on a bottom surface of the first film layer, wherein the first circuit pattern has a plurality of upper contacts. The lower wiring board includes a second film layer, a second circuit pattern and a light reflective element arranged between the second film layer and the second circuit pattern. The second circuit pattern has a plurality of lower contacts corresponding to respective upper contacts. A refractive index of the light reflective element is lower than a refractive index of the second film layer. Each of the upper contacts and the corresponding lower contact are separated from each other by a spacing interval. In addition, each of the upper contacts and the corresponding lower contact are collectively defined as a membrane switch.

In an embodiment, the second circuit pattern includes a plurality of metallic conductor lines.

In an embodiment, the metallic conductor lines are silver paste conductor lines.

In an embodiment, the light reflective element is a single film layer, and the metallic conductor lines are formed on the single film layer.

In an embodiment, the light reflective element is formed on the second film layer by a printing process, a film deposition process, a gluing In an embodiment, the light reflective element includes a plurality of separate block-type film layers, and the metallic conductor lines are formed on the block-type film layers.

In an embodiment, the block-type film layers are formed on the second film layer by a printing process, a film deposition process, a gluing process or a thermal compression process.

In an embodiment, the second film layer is a light-guiding film layer.

In an embodiment, the light-guiding film layer is made of polycarbonate (PC), polyethylene terephthalate (PET) or polymethylmethacrylate (PMMA).

In an embodiment, the membrane circuit board further includes an intermediate board, which is arranged between the upper wiring board and the lower wiring board, so that each of the upper contacts and the corresponding lower contact are separated from each other by the spacing interval. Moreover, the intermediate board has a plurality of perforations corresponding to the lower contacts and the upper contacts.

In an embodiment, the membrane circuit board is included in a luminous keyboard.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
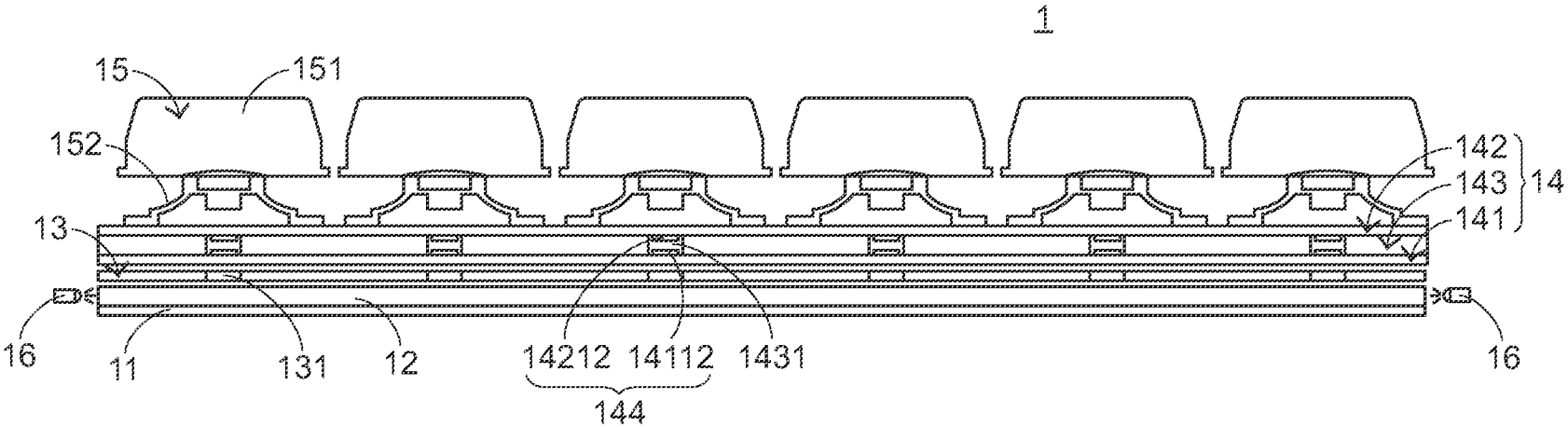
FIG. 1 PRIOR ART
FIG. 1 is a schematic cross-sectional view illustrating a luminous keyboard according to the prior art.
Figure 2:
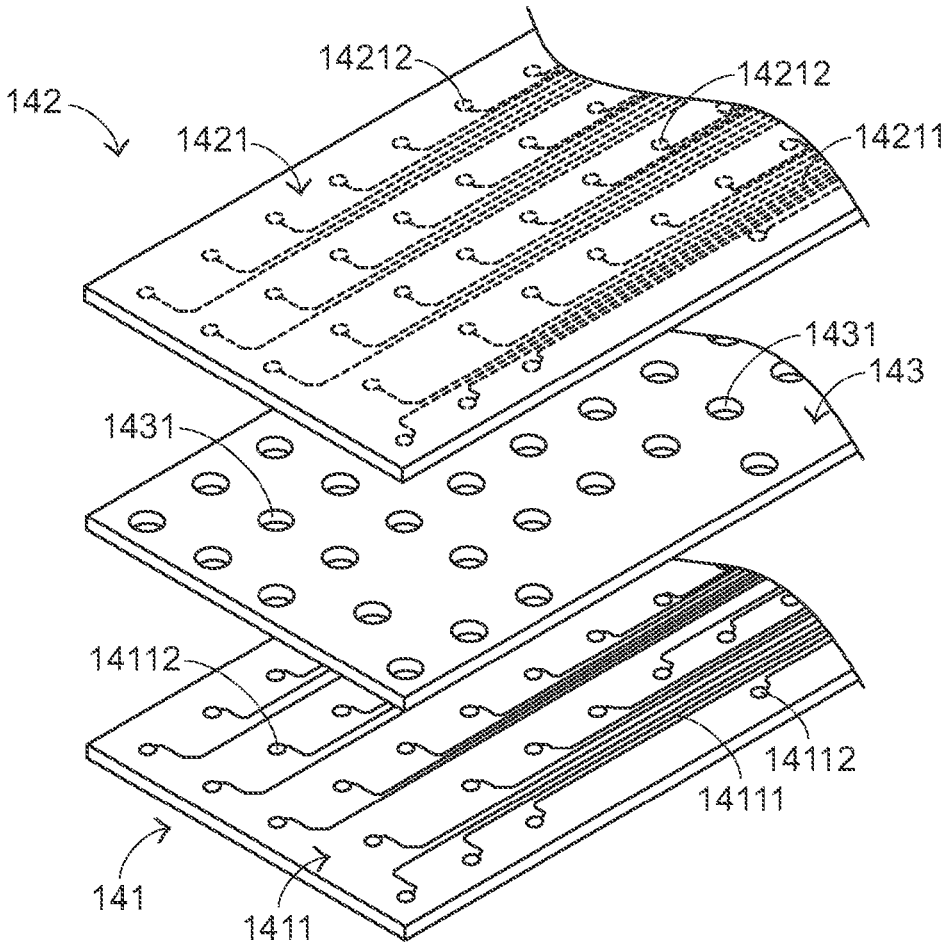
FIG.2 PRIOR ART
FIG. 2 is a schematic exploded view illustrating a membrane circuit board of the luminous keyboard of FIG. 1.
Figure 3:
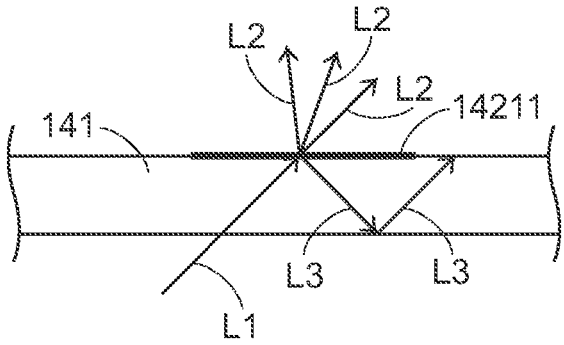
FIG.3 PRIOR ART
FIG. 3 schematically illustrates a light path in the lower wiring board of the membrane circuit board F of FIG. 2.
Figure 4:
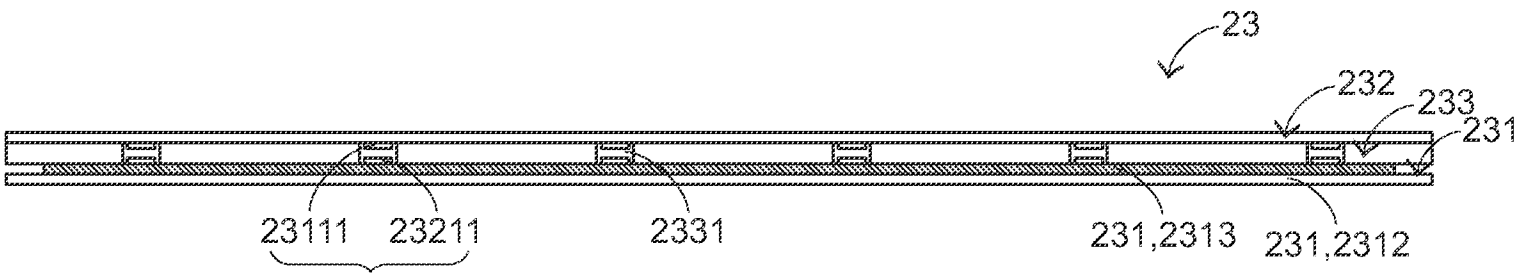
FIG. 4 is a schematic side view illustrating a membrane circuit board according to a first embodiment of the present invention.
Figure 5:
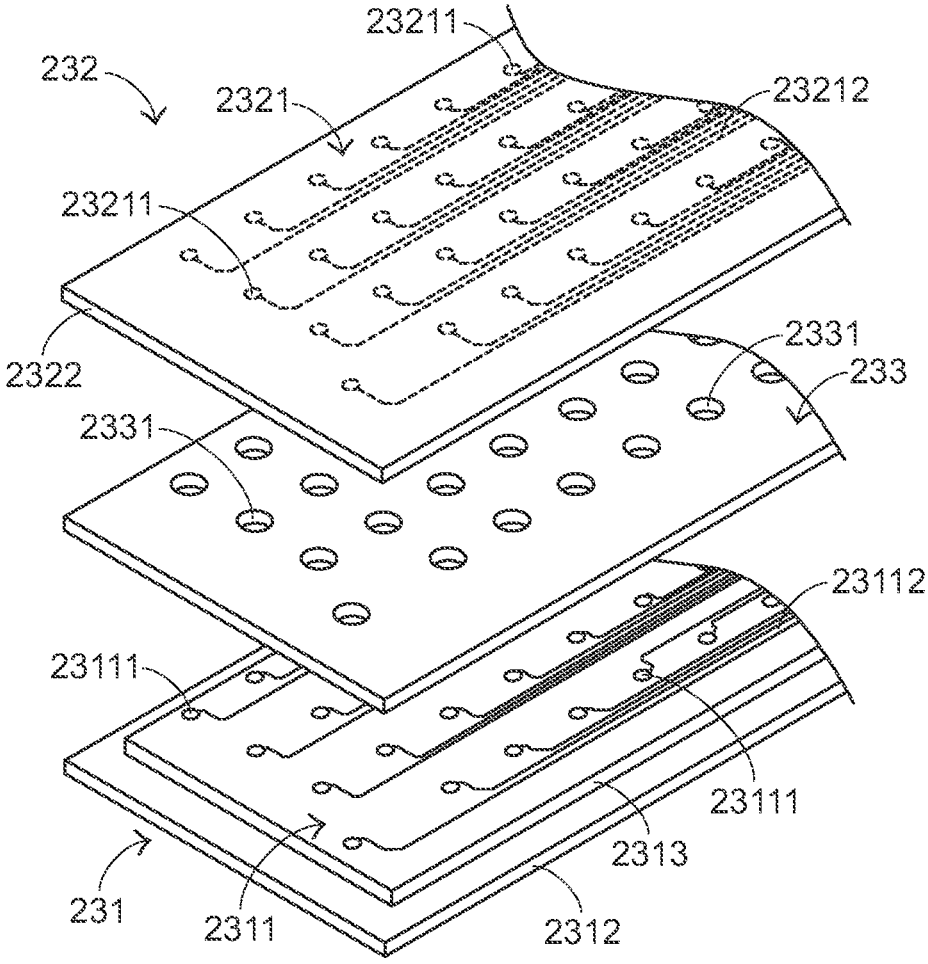
FIG. 5 is a schematic exploded view illustrating the membrane circuit board of FIG. 4.

FIG. 4 is a schematic side view illustrating a membrane circuit board according to a first embodiment of the present invention. FIG. 5 is a schematic exploded view illustrating the membrane circuit board of FIG. 4. Please refer to FIGS. 4 and 5. The membrane circuit board 23 comprises an upper wiring board 232 and a lower wiring board 231. The upper wiring board 232 comprises a first film layer 2322 and a first circuit pattern 2321. The first circuit pattern 2321 is formed on a bottom surface of the first film layer 2322. The first circuit pattern 2321 comprises a plurality of upper contacts 23211 and a plurality of metallic conductor lines 23212. The lower wiring board 231 comprises a second film layer 2312, a second circuit pattern 2311 and a light reflective element 2313. The light reflective element 2313 is arranged between the second film layer 2312 and the second circuit pattern 2311. The second circuit pattern 2311 has a plurality of metallic conductor lines 23112 and a plurality of lower contacts 23111 corresponding to respective upper contacts 23211.

Each of the upper contacts 23211 and the corresponding lower contact 23111 are separated from each other by a spacing interval D. Moreover, each of the upper contacts 23211 and the corresponding lower contact 23111 are collectively defined as a membrane switch 234. In a case that each of the upper contacts 23211 is contacted with the corresponding lower contact 23111, the corresponding membrane switch 234 is electrically conducted, and thus a corresponding key signal is generated. Moreover, for maintaining the spacing interval D between each upper contact 23211 and the corresponding lower contact 23111, the membrane circuit board 23 further comprises an intermediate board 233. The intermediate board 233 is arranged between the lower wiring board 231 and the upper wiring board 232. In addition, the intermediate board 233 has a plurality of perforations 2331 corresponding to the lower contacts 23111 and the upper contacts 23211.

In this embodiment, the second film layer 2312 is a light-guiding film layer. After the light beams are incident into the second film layer 2312, the light beams can be diffused within the second film layer 2312. In this embodiment, the second film layer 2312 is made of a light-guiding material. The light-guiding material includes but is not limited to polycarbonate (PC), polyethylene terephthalate (PET) or polymethylmethacrylate (PMMA). Moreover, in this embodiment, the light reflective element 2313 is a single film layer, which can be formed on the second film layer 2312 by a printing process, a film deposition process, a gluing process or a thermal compression process. It is noted that the refractive index of the light reflective element 2313 is lower than the refractive index of the second film layer 2312. In an embodiment, the metallic conductor lines 23112 of the second circuit pattern 2311 are silver paste conductor lines because of high thermal conductivity thereof. In addition, these metallic conductor lines 23112 are all formed on the light reflective element 2313 (i.e. a single film layer).

Figure 6:
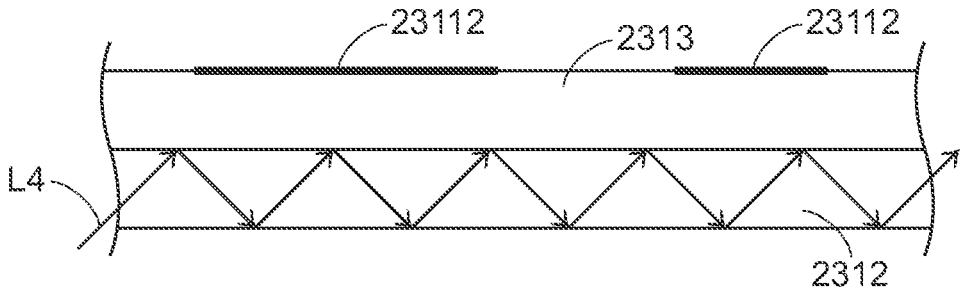
FIG. 6 schematically illustrates a light path in the lower wiring board of the membrane circuit board of FIG. 4.

FIG. 6 schematically illustrates a light path in the lower wiring board of the membrane circuit board of FIG. 4. Since the refractive index of the light reflective element 2313 is lower than the refractive index of the second film layer 2312, when the light beams L4 are laterally incident into the lower wiring board 231 of the membrane circuit board 23, a great portion of the light beams L4 are subject to total internal reflection. Under this circumstance, the percentage of the light beams L4 to be absorbed and collected by the metallic conductor lines 23112 of the second circuit pattern 2311 will be largely reduced. In other words, the consumption of light energy will be effectively reduced. Consequently, the light beams provided to the lower wiring board 231 can be uniformly diffused to the whole second film layer 2312.

Figure 7:
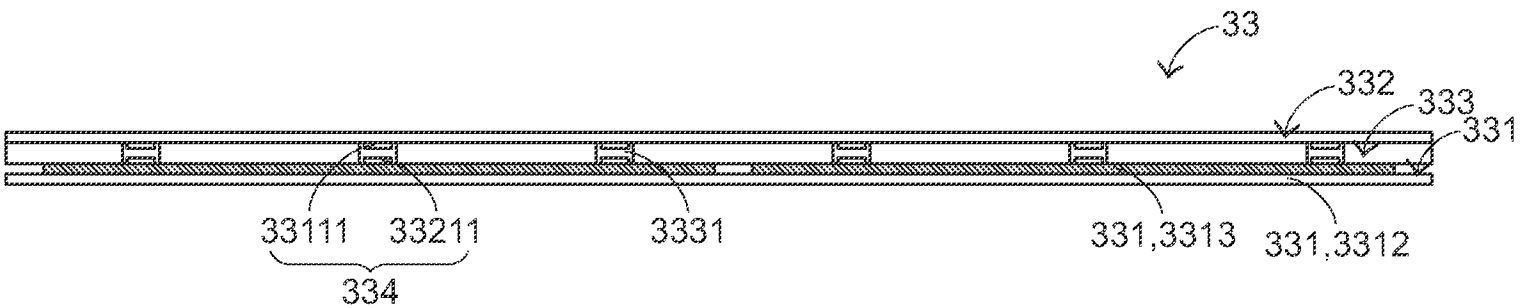
FIG. 7 is a schematic side view illustrating a membrane circuit board according to a second embodiment of the present invention.
Figure 8:
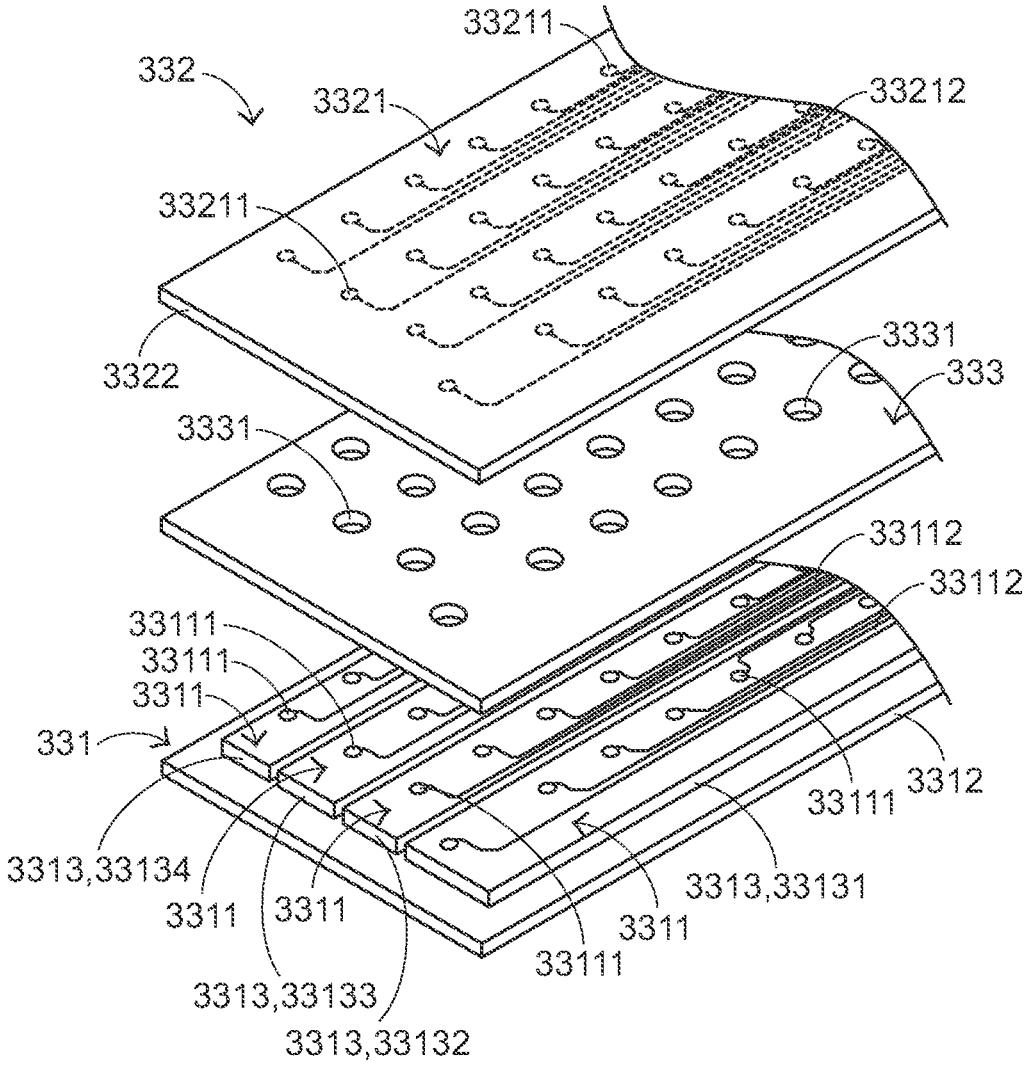
FIG. 8 is a schematic exploded view illustrating the membrane circuit board of FIG. 7.

FIG. 7 is a schematic side view illustrating a membrane circuit board according to a second embodiment of the present invention. FIG. 8 is a schematic exploded view illustrating the membrane circuit board of FIG. 7. Please refer to FIGS. 7 and 8. The membrane circuit board 33 comprises an upper wiring board 332 and a lower wiring board 331. The upper wiring board 332 comprises a first film layer 3322 and a first circuit pattern 3321. The first circuit pattern 3321 is formed on a bottom surface of the first film layer 3322. The first circuit pattern 3321 comprises a plurality of upper contacts 33211 and a plurality of metallic conductor lines 33212. The lower wiring board 331 comprises a second film layer 3312, a second circuit pattern 3311 and a light reflective element 3313. The light reflective element 3313 is arranged between the second film layer 3312 and the second circuit pattern 3311. The second circuit pattern 3311 has a plurality of metallic conductor lines 33112 and a plurality of lower contacts 33111 corresponding to respective upper contacts 33211.

Each of the upper contacts 33211 and the corresponding lower contact 33111 are separated from each other by a spacing interval D. Moreover, each of the upper contacts 33211 and the corresponding lower contact 33111 are collectively defined as a membrane switch 334. In a case that each of the upper contacts 33211 is contacted with the corresponding lower contact 33111, the corresponding membrane switch 334 is electrically conducted, and thus a corresponding key signal is generated. Moreover, for maintaining the spacing interval D between each upper contact 33211 and the corresponding lower contact 33111, the membrane circuit board 33 further comprises an intermediate board 333. The intermediate board 333 is arranged between the lower wiring board 331 and the upper wiring board 332. In addition, the intermediate board 333 has a plurality of perforations 3331 corresponding to the lower contacts 33111 and the upper contacts 33211.

In this embodiment, the second film layer 3312 is a light-guiding film layer. After the light beams are incident into the second film layer 3312, the light beams can be diffused within the second film layer 3312. In this embodiment, the second film layer 3312 is made of a light-guiding material. The light-guiding material includes but is not limited to polycarbonate (PC), polyethylene terephthalate (PET) or polymethylmethacrylate (PMMA). Moreover, in this embodiment, the light reflective element 3313 comprises a plurality of separate block-type film layers 33131, 33132, 33133 and 33134, which can be formed on the second film layer 3312 by a printing process, a film deposition process, a gluing process or a thermal compression process. It is noted that the refractive index of each of the block-type film layers 33131, 33132, 33133 and 33134 is lower than the refractive index of the second film layer 3312.

In an embodiment, the metallic conductor lines 33112 of the second circuit pattern 3311 are silver paste conductor lines because of high thermal conductivity thereof. In addition, these metallic conductor lines 33112 are formed on the block-type film layers 33131, 33132, 33133 and 33134. However, those skilled in the art will readily observe that numerous modifications and alterations may be made while retaining the teachings of the invention. For example, some of the metallic conductor lines 33112 are formed across and on two of these block-type film layers 33131, 33132, 33133 and 33134.

Figure 9:
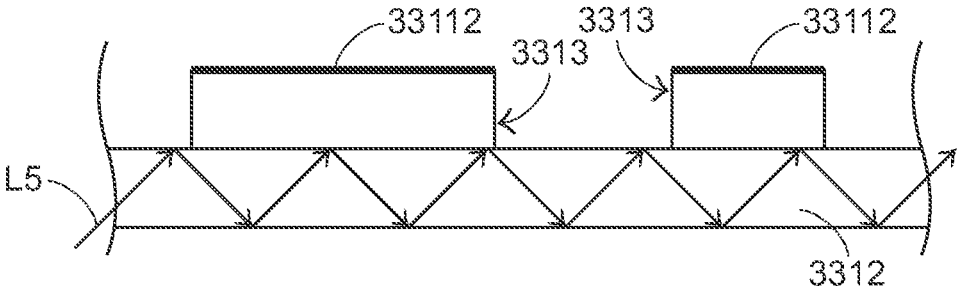
FIG. 9 schematically illustrates a light path in the lower wiring board of the membrane circuit board of FIG. 8.

FIG. 9 schematically illustrates a light path in the lower wiring board of the membrane circuit board of FIG. 8. As known, since the refractive index of air is 1, nearly none of the current optical media has refractive index higher than air. Consequently, when the light beams L5 are laterally incident into the lower wiring board 331 of the membrane circuit board 33, the region of the second film layer 3312 uncovered by the light reflective element 3313 are subject to total internal reflection most effectively. In other words, the efficacy of the total internal reflection of the light beams L5 in the second film layer 3312 of this embodiment is better than that of the first embodiment. Consequently, the light beams provided to the lower wiring board 331 can be diffused to the whole second film layer 3312 more uniformly.

Figure 10:
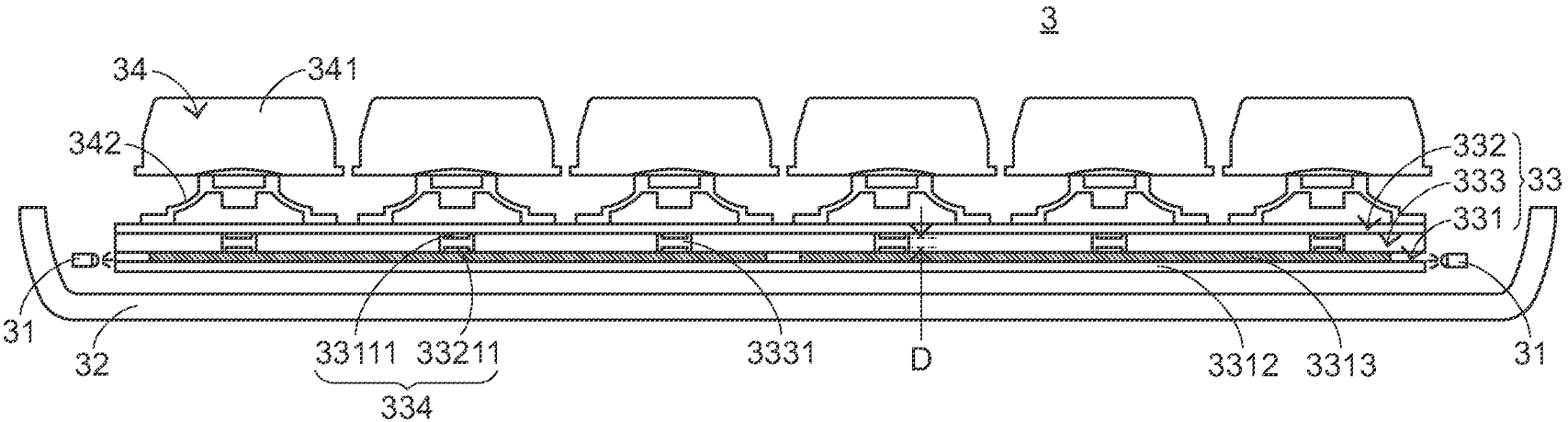
FIG. 10 is a schematic cross-sectional view illustrating a luminous keyboard using the membrane circuit boar according to the second embodiment of the present invention.

FIG. 10 is a schematic cross-sectional view illustrating a luminous keyboard using the membrane circuit boar according to the second embodiment of the present invention. From top to bottom, a base plate 32, a membrane circuit board 33 and a plurality of keys 34 of the luminous keyboard 3 are sequentially shown. The base plate 32 is used for supporting the membrane circuit board 33 and the keys 34.

Moreover, the luminous keyboard further comprises a plurality of keys 34 corresponding to the membrane switches 334. Each of the keys 34 comprises a keycap 341 and an elastic element 342. The elastic element 342 is arranged between a corresponding keycap 341 and the membrane circuit board 33. When any key 34 is pressed down by a user, the elastic element 342 is compressed by the keycap 341, so that a corresponding membrane switch 344 is electrically conducted. Whereas, when the depressing force exerted on the keycap 341 is eliminated, an elastic force provided by the elastic element 342 is acted on the keycap 341. Due to the elastic force, the keycap 341 is moved upwardly and returned to its original position.

Moreover, the luminous keyboard 3 further comprises at least one light-emitting element 31. In this embodiment, the light-emitting element 31 is a light emitting diode. The light-emitting element 31 is located beside the membrane circuit board 33 for emitting light beams, which are laterally incident into the membrane circuit board 33. When the light beams emitted by the light-emitting element 31 are incident into the lower wiring board 331 of the membrane circuit board 33, the light beams will be uniformly diffused into the whole second film layer 3312. Under this circumstance, the regions under the keys 35 of the luminous keyboard 3 are effectively illuminated, and thus the light use efficiency of the luminous keyboard is enhanced.

It is to be noted that the above descriptions of preferred embodiments of the membrane circuit board of the present invention are presented herein for purpose of illustration and description only. Those skilled in the art will readily observe that the membrane circuit board of the first embodiment may be applied to the luminous keyboard while retaining the teachings of the invention. Moreover, those skilled in the art will readily observe that membrane circuit boards of the above embodiments may be applied to other devices such as the backlight key modules of mobile phones or the backlight key modules of remote controllers.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A luminous keyboard, comprising:

at least one light-emitting element for providing light beams to illuminate said luminous keyboard;

a membrane circuit board comprising:

an upper wiring board comprising a first film layer and a first circuit pattern formed on a bottom surface of said first film layer, wherein said first circuit pattern has a plurality of upper contacts; and a lower wiring board comprising a second film layer, a second circuit pattern and a light reflective element arranged on said second film layer, wherein said second film layer comprises a light-guiding film layer and said second circuit pattern is formed on said light reflective element and has a plurality of lower contacts corresponding to respective upper contacts, wherein each of said upper contacts and said corresponding lower contacts are separated from each other by a spacing interval, and each of said upper contacts and said corresponding lower contacts are collectively defined as a membrane switch, wherein said light-emitting element is located beside said membrane circuit board for emitting said light beams toward said membrane circuit board and a refractive index of said light reflective element is lower than a refractive index of said second film layer such that a great portion of the light beams are subject to total internal reflection in the light-guiding film layer; and a plurality of keys, wherein when said keys are triggered, respective membrane switches are conducted.

2. The luminous keyboard according to claim 1 wherein said second circuit pattern comprises a plurality of metallic conductor lines.

3. The luminous keyboard according to claim 2 wherein said metallic conductor lines are silver paste conductor lines.

4. The luminous keyboard according to claim 2 wherein said light reflective element is a single film layer, and said metallic conductor lines are formed on said single film layer.

5. The luminous keyboard according to claim 4 wherein said light reflective element is formed on said second film layer by a printing process, a film deposition process, a gluing process or a thermal compression process.

6. The luminous keyboard according to claim 2 wherein said light reflective element comprises a plurality of separate block-type film layers, and said metallic conductor lines are formed on said block-type film layers.

7. The luminous keyboard according to claim 6 wherein said block-type film layers are formed on said second film layer by a printing process, a film deposition process, a gluing process or a thermal compression process.

8. The luminous keyboard according to claim 1 wherein said light-guiding film layer is made of polycarbonate (PC), polyethylene terephthalate (PET) or polymethylmethacrylate (PMMA).

9. The luminous keyboard according to claim 1 wherein said light-emitting element is a light emitting diode.

10. The luminous keyboard according to claim 1 further comprising a base plate, wherein said base plate is disposed under said membrane circuit board for supporting said keys, said membrane circuit board and said light-emitting element.

11. The luminous keyboard according to claim 1 wherein each of said keys has a keycap and an elastic element, and said elastic element is arranged between said keycap and said membrane circuit board, wherein when said keycap is pressed down, said elastic element is compressed by said keycap to push against a corresponding membrane switch, wherein when a depressing force exerted on said keycap is eliminated, an elastic force provided by said elastic element is acted on said keycap, so that said keycap is returned to an original position.

12. The luminous keyboard according to claim 1 wherein said membrane circuit board further comprises an intermediate board, which is arranged between said upper wiring board and said lower wiring board, so that each of said upper contacts and said corresponding lower contact are separated from each other by said spacing interval, wherein said intermediate board has a plurality of perforations corresponding to said lower contacts and said upper contacts.

13. A membrane circuit board, comprising:

an upper wiring board comprising a first film layer and a first circuit pattern formed on a bottom surface of said first film layer, wherein said first circuit pattern has a plurality of upper contacts; and a lower wiring board comprising a second film layer, a second circuit pattern and a light reflective element arranged on said second film layer, wherein said second film layer comprises a light-guiding film layer and second circuit pattern is formed on the light reflective element and has a plurality of lower contacts corresponding to respective upper contacts, and a refractive index of said light reflective element is lower than a refractive index of said second film layer;

wherein each of said upper contacts and said corresponding lower contact are separated from each other by a spacing interval, and each of said upper contacts and said corresponding lower contact are collectively defined as a membrane switch.

14. The membrane circuit board according to claim 13 wherein said second circuit pattern comprises a plurality of metallic conductor lines.

15. The membrane circuit board according to claim 14 wherein said metallic conductor lines are silver paste conductor lines.

16. The membrane circuit board according to claim 14 wherein said light reflective element is a single film layer, and said metallic conductor lines are formed on said single film layer.

17. The membrane circuit board according to claim 16 wherein said light reflective element is formed on said second film layer by a printing process, a film deposition process, a gluing process or a thermal compression process.

18. The membrane circuit board according to claim 14 wherein said light reflective element comprises a plurality of separate block-type film layers, and said metallic conductor lines are formed on said block-type film layers.

19. The membrane circuit board according to claim 18 wherein said block-type film layers are formed on said second film layer by a printing process, a film deposition process, a gluing process or a thermal compression process.

20. The membrane circuit board according to claim 13 wherein said light-guiding film layer is made of polycarbonate (PC), polyethylene terephthalate (PET) or polymethylmethacrylate (PMMA).

21. The membrane circuit board according to claim 13 wherein said membrane circuit board further comprises an intermediate board, which is arranged between said upper wiring board and said lower wiring board, so that each of said upper contacts and said corresponding lower contact are separated from each other by said spacing interval, wherein said intermediate board has a plurality of perforations corresponding to said lower contacts and said upper contacts.

22. The membrane circuit board according to claim 13 wherein said membrane circuit board is included in a luminous keyboard.

* * * * *